US006178902B1

(12) United States Patent
Nöltge et al.

(10) Patent No.: US 6,178,902 B1
(45) Date of Patent: Jan. 30, 2001

(54) THREAD-CUTTING DEVICE FOR AN EYELET BUTTONHOLE SEWING MACHINE

(75) Inventors: Thomas Nöltge, Schloss Holte; Eberhard Kastrup, Bielefeld, both of (DE)

(73) Assignee: Dürkopp Adler Aktiengesellschaft, Bielefeld (DE)

( * ) Notice: Under 35 U.S.C. 154(b), the term of this patent shall be extended for 0 days.

(21) Appl. No.: 09/218,785

(22) Filed: Dec. 22, 1998

(30) Foreign Application Priority Data

Jan. 15, 1998 (DE) ..... 198 01 226

(51) Int. Cl.[7] ..... D05B 63/00
(52) U.S. Cl. ..... 112/68; 112/291
(58) Field of Search ..... 112/65, 66, 68, 112/291, 295, 296, 298, 301

(56) References Cited

U.S. PATENT DOCUMENTS

| | | | | |
|---|---|---|---|---|
| 1,373,227 | * | 3/1921 | Fifield | 112/291 |
| 1,705,044 | * | 3/1929 | Carlson | 112/291 |
| 1,991,627 | | 2/1935 | Reece . | |
| 2,020,779 | | 11/1935 | Grip . | |
| 2,499,335 | * | 2/1950 | Spaine | 112/291 |
| 2,707,927 | * | 5/1955 | Artzt et al. | 112/291 |
| 4,404,921 | * | 9/1983 | Kastrup et al. | 112/291 |
| 4,594,954 | | 2/1985 | Bernewasser . | |
| 5,647,290 | | 7/1997 | Kastrup et al. . | |

FOREIGN PATENT DOCUMENTS

| | | |
|---|---|---|
| 631138 | 5/1936 | (DE) . |
| 4436613 | 10/1994 | (DE) . |
| 19531727 | 8/1995 | (DE) . |

OTHER PUBLICATIONS

Dürkopp Alder "Gestern Heute Morgen", 578–113221 E831/18.

KL 110 CNC Sewing Unit With Rotating Sewing Head, KSL GmbH Keilmann (Nov. 5, 1996).

Dürkopp Adler "Gestern Heute Morgen", Exhibit 30 at the IMB Fair 1997 in Cologne.

* cited by examiner

*Primary Examiner*—Ismael Izaguirre
(74) *Attorney, Agent, or Firm*—Ostrolenk, Faber, Gerb & Soffen, LLP

(57) ABSTRACT

Thread-cutting device for an eyelet buttonhole sewing machine, having a looper support (70) which can rotate about a vertical axis (22) and is fitted with mutually independently operable thread-cutting tools (42, 53) for a looper thread (60) and a needle thread. Provided on the looper support (70) are drive devices in the form of pneumatic cylinders (29, 30) for the thread-cutting tools (42, 53), which drive devices can be fed compressed air from a stationary compressed air source via a device (69) in the form of elastic hoses (33, 37) or of a rotary bushing. The thread-cutting device according to the invention permits the thread-cutting tools (42, 53) to be operated irrespective of the rotary position of the looper support (70).

10 Claims, 4 Drawing Sheets

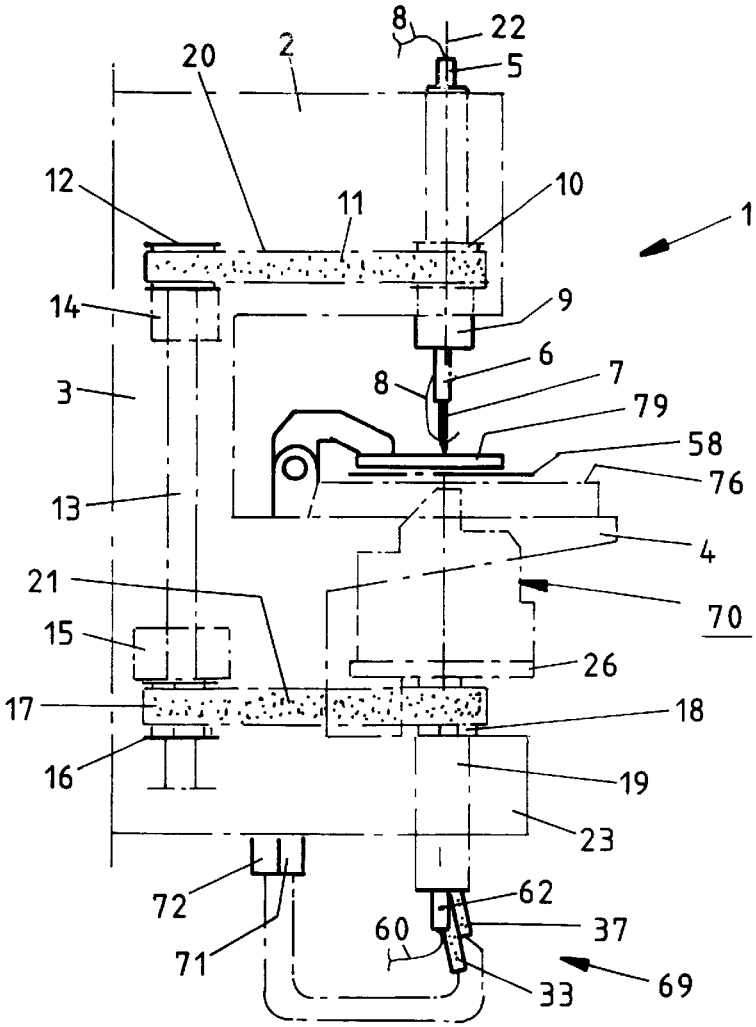
Fig. 1
Fig. 7
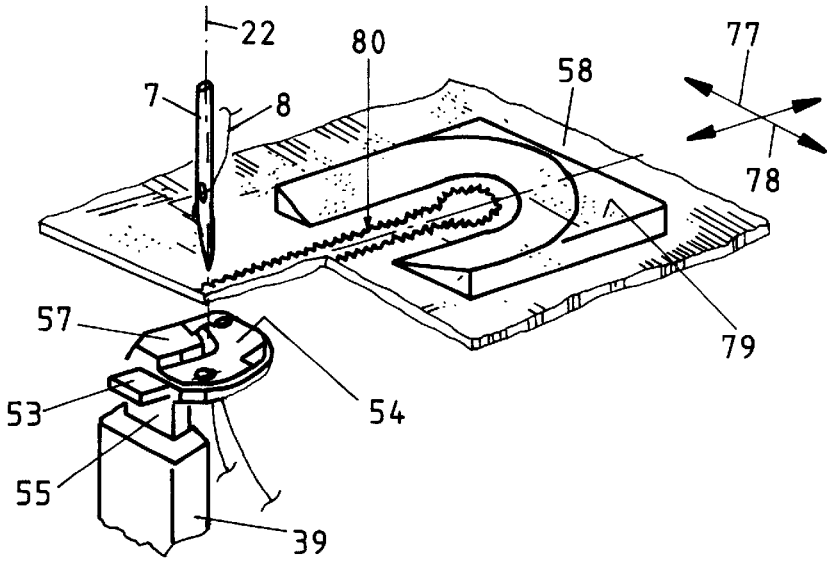

V
III
IV
70
22
57
53
51
50
42
60
61
45
47
46
38
59
40
41
48
39
49
36
33
37
29
35
39
34
30
31
27
17
24
23
25
26
19
66
67
62
37
63
69
60
33

22
7
57
58
54
42
50
39
41
40
43
38
44
64
30
28
27
18
19
65
66
67
68

41
66
68
65
70
49
40
31
38
29
28
30
45
46
32
39
64
67

Fig. 4
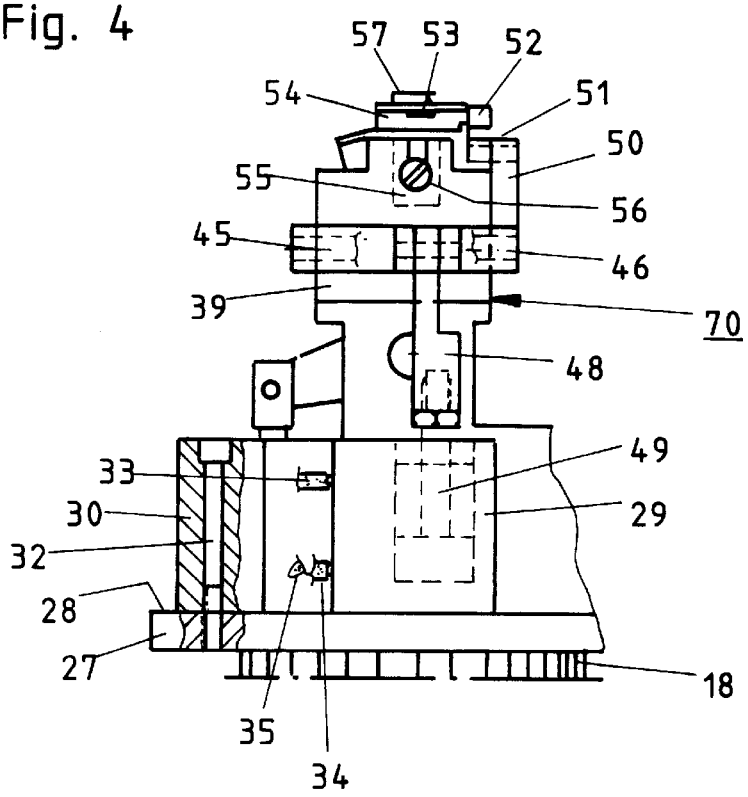
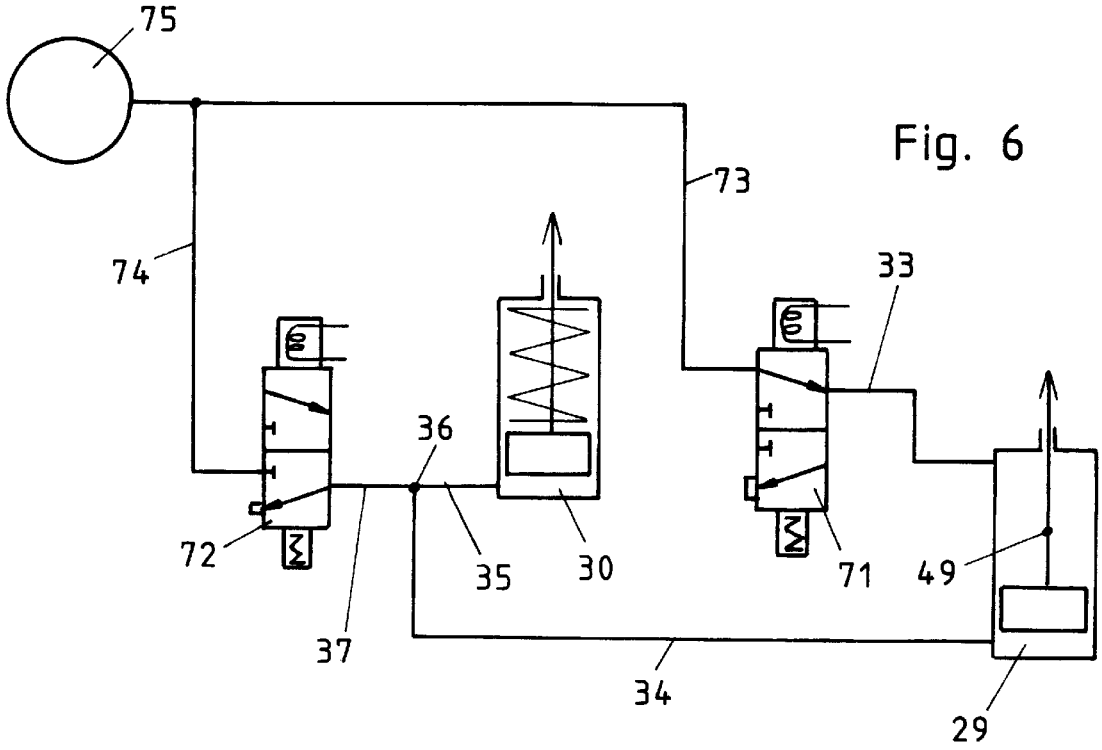
Fig. 6

THREAD-CUTTING DEVICE FOR AN EYELET BUTTONHOLE SEWING MACHINE

BACKGROUND OF THE INVENTION

The present invention relates to a thread-cutting device for an eyelet buttonhole sewing machine according to the preamble of claim 1.

An eyelet buttonhole sewing machine of the generic type became known as Exhibit 30 at the IMB Fair of 1997 in Cologne as Dürkopp Adler Class 578-113221 E831 (recently designated as Cl. 578-113221 E1831), with which a stitch row is produced which is designed in the shape of a zig-zag and in alternating fashion as a single chain and double chain stitch seam. The eyelet buttonhole sewing machine includes rotatable sewing tools, including a rotatable looper support arranged below the support for the material to be sewn. It is possible to rotate the sewing tools and the looper support about an axis extending parallel to the longitudinal axis of the sewing needle. A thread cutter is arranged on the rotary looper support and is constructed with one thread-cutting tool for the needle thread and with another thread-cutting tool for the looper thread. Each thread-cutting tool can be moved independently of the other and may be operated via separate drives. Required movements for the thread-cutting tools are initiated by producing the drive connection from the thread-cutting tools to the drives arranged in a stationary fashion on the sewing machine frame in a defined rotary position of the looper support. Consequently, the thread-cutting device and/or the individual thread-cutting tools can be driven only subsequently, thus lengthening the machine cycle.

In principle, movement is initiated for a thread cutter of an eyelet buttonhole sewing machine as disclosed in DE-C 631 138.

Furthermore, disadvantages relating to application or use are entailed by the design described. Thus, even when laying out a seam, it is necessary for its end to always be aligned and/or arranged such that the looper support assumes the rotary position which permits thread cutting. In specific applications this leads to limitations which impair the appearance of a buttonhole produced. Furthermore, specific seam shapes, for example, a lacing hole, can cause limitations with regard to the position of the lacing hole relative to the actual part of the material to be sewn, and thus cause a reduction in quality.

There is further difficulty when it is intended to use the main cam plate for the thread-cutting device, as that plate rotates by only a few angular degrees. The eyelet buttonhole sewing machine may not receive the required drive movement at the end of the sewing operation.

The number of components which are required for the drive linkage to operate the thread-cutting device is also disadvantageous, including the required couplings for producing the drive connection in the defined position of the looper support relative to the machine housing and to the drives mounted thereon.

SUMMARY OF THE INVENTION

It is an object of the present invention to develop a thread-cutting device of the type useful for an eyelet buttonhole sewing machine such that its thread-cutting tools can be driven in any rotary position of the looper support.

This object is achieved with a thread cutting device for an eyelet buttonhole sewing machine. The machine includes a looper support that is rotatable about an axis and that is for receiving a looper thread that is fed to the support. A needle also extends essentially on the axis and is for receiving a needle thread. There is a first thread cutting tool for the needle thread, and a second thread cutting tool for the looper thread which are both mounted on the looper support and which are both moveable with respect to the looper support. There is a first drive for the first thread cutting tool, a second drive for the second thread cutting tool and both of the drives are on the looper support. An energy supply device supplies the first and second drives with energy.

The invention is distinguished by the following advantages:

- the thread cutter can operate irrespective of the looper support,
- the machine cycle period can be shortened by overlapping operations of the looper support rotation and the thread cutter drive,
- enhancement of the stitch pattern quality by removing any restrictions in the structural design of a stitch pattern to be produced, as well as its arrangement in the part of the material to be sewn,
- a low number of components required, lowering production costs and enhancing reliability,
- the thread-cutting device is a perfect component of the looper support, making the looper support a cost-effective unit which can be preassembled.

A sewing unit from KSL GmbH Keilmann discloses an arrangement of a drive device on the looper support, which can be rotated about a spindle, for operating a thread cutter. A sewing unit in which a rotatable sewing head is always aligned tangential to the course of the seam is disclosed in a brochure KL 110 CNC Sewing Unit with rotating sewing head, Impressum j/11Obrief, Nov. 5, 1996, and the associated description pages 2 and 3 of the CNC sewing unit from KSL GmbH Keilmann. As is further described and as is known from public presentations of such machines at fairs, the sewing head can be configured with a double lock stitch or double chain stitch design and with a thread cutter arranged on the rotary looper support. In this case, a pneumatic cylinder arranged on the looper support operates a single thread-pulling and thread-cutting tool gripping the needle thread and looper thread. This prior art does not suggest using separate drive devices to drive the thread-cutting tools required for the needle thread and the looper thread in the case of an eyelet buttonhole sewing machine.

The invention permits the supply of energy from a stationary energy source via at least one line. An energy supply which can be subjected to high loads is achieved with a hollow shaft that extends around the axis and through which the at least one line extends. Providing at least one of the drive devices with a pneumatic cylinder for drive purposes leads to a simple and operationally reliable drive device by means of which it is possible to achieve relatively high forces with respect to its required overall volume. When that pneumatic cylinder is constructed as a double action pneumatic cylinder, this leads to a drive for a thread cutter which can be subjected to greater loads. Having one of the drive devices as a single action pneumatic cylinder and the other as a double action pneumatic cylinder yields the advantage of a simple and yet separate control of the individual pneumatic cylinders. Mounting the pneumatic cylinders on the looper support so that their axis or axes extend parallel to the main axis leads to a space-saving design. The looper support has a flange which extends radially relative to the axis and the pneumatic cylinder is fastened on the flange. This has design advantages for arranging the drive devices.

Constructing the lines as elastic hoses leads to a cost-effective and reliable operating solution for connecting the drive devices to a stationary compressed air source. Providing a rotary bushing for delivery of compressed air from the stationary energy source to the drive devices permits complete freedom of movement with regard to the rotary position of the looper support with the thread-cutting tools arranged thereon. This has the advantage that it is possible to achieve desired rotary positions of the looper support in a minimum time.

It is known from DE 34 11 178 C2 (corresponding to U.S. Pat. No. 4,594,954) to feed compressed air from a stationary compressed air source to a rotary housing via a rotary bushing.

Other features and advantages of the present invention will become apparent from the following description of the invention which refers to the accompanying drawings.

BRIEF DESCRIPTION OF THE DRAWINGS

FIG. 1 shows an elevational view of a part of an eyelet buttonhole sewing machine, FIG. 4 shows a part of the region, shown in FIG. 2, in the direction of the viewing arrow IV in FIG. 2, FIG. 6 shows a diagrammatic representation of a pneumatic circuit diagram, FIG. 7 shows a perspective view of stitch-forming region of the eyelet buttonhole sewing machine.

DETAILED DESCRIPTION OF THE INVENTION

Figure 2:
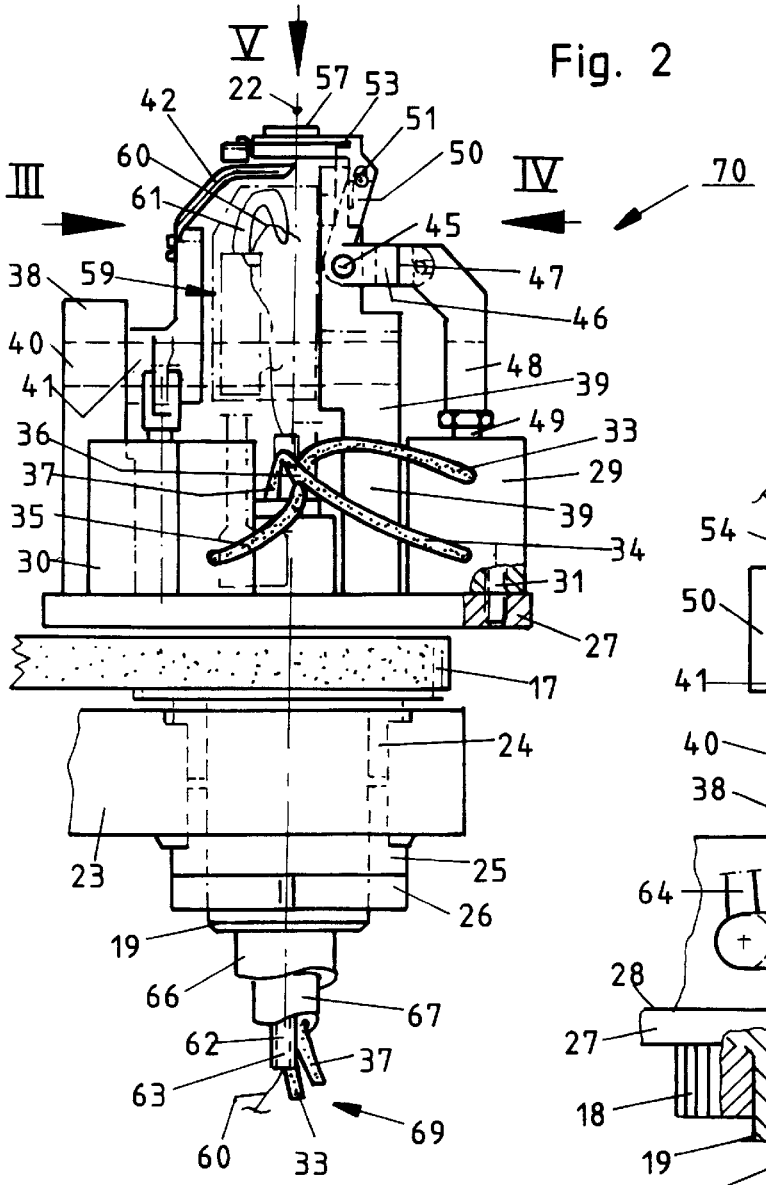
FIG. 2 shows an elevational view of a part of the machine of FIG. 1 on an enlarged scale.

An eyelet buttonhole sewing machine 1 has conventional features, includes an arm 2, a frame 3 and a baseplate 4. Drive means (not marked) are provided in the arm 2 for driving a needle bar 5 up and down. The bar, is of tubular construction and is fitted at its lower end 6 with a needle 7. A needle thread 8 is fed from a thread supply (not shown) to the inner bore of the needle bar 5, through which the thread extends. The thread emerges at the lower end 6 of the bar 5, and is guided through the eye of the needle 7.

The needle bar 5 is held in a bearing 9 in a longitudinally displaceable fashion, and is guided in that bearing with regard to its rotary position. The special configuration of the bearing 9 disclosed in U.S. Pat. No. 1,991,627 further permits the needle bar 5 the possibility of being imparted a swivelling movement.

Furthermore, a toothed-belt wheel 10 on the bearing 9 is wrapped around by a toothed belt 11. The toothed belt 11 is also wrapped around a toothed belt wheel 12 which is permanently connected to the upper end of a shaft 13. The shaft 13 is rotatably mounted in an upper bearing 14 which is up and close to the arm 2 and in a lower bearing 15 which is in the region of the baseplate 4. A toothed belt wheel 16 is fastened on the shaft 13 below the bearing 15. The wheel 16 is wrapped around by a toothed belt 17. The toothed belt 17 also wraps around a toothed belt wheel 18 which is fastened on a hollow shaft 19. An upper toothed belt drive 20 is formed with the toothed belt wheels 10, 12 and the toothed belt 11. A lower toothed belt drive 21 is formed with the toothed belt wheels 16, 18 and the toothed belt 17. Both toothed belt drives 20, 21 each have a transmission ratio of i=1. Furthermore, toothed wheels 10 and 18 are arranged on an axis 22 that extends vertically. Apart from slight deflection movements, the needle bar 5 extends likewise with the needle 7 on the axis 22.

The hollow shaft 19 which supports the toothed belt wheel 18 is rotatably held in the bearing 23. The bearing 23 is constructed with two bearing bushes 24, 25. The hollow shaft 19 is mounted in the bearing bushes 24, 25 and is secured axially with a clamping ring 26. The hollow shaft 19 is constructed with a flange 27 which extends radially relative to the axis 22. The flange 27 has an end face 28 on which a pneumatic cylinder 29 and a pneumatic cylinder 30 are fastened with screws 31 and 32. The pneumatic cylinder 29 is a double-action cylinder, and is consequently connected to lines 33, 34. In contrast, the pneumatic cylinder 30 is a single-action pneumatic cylinder, and is consequently connected to a line 35. The lines 34, 35 terminate at a Y-shaped connecting piece 36, from which a line 37 departs.

A bearing block 38 and a bearing block 39 which, as shown in FIG. 2, sit on the flange 27 and extend upward from the end face 28 of the flange. The bearing blocks 38, 39 are constructed with mutually aligned bores in which a spindle 40 is permanently held. The spindle 40 is arranged essentially centrally and at right angles to the axis 22. A pivoted lever 41 is rotatably mounted on the spindle 40 and the lever carries a thread-cutting blade 42 at one end. Furthermore, the pivoted lever 41 includes a lever arm 43 with a free, fork shaped end that is in drive connection via a bolt (not shown) with a piston rod 44 of the pneumatic cylinder 30.

A swivel bearing 45 located on the bearing block 39 movably holds an angle lever 46 that is in the shape of a U. The angle lever 46 is connected by one arm (not marked) to a transmitting part 48 via a swivel/slide joint 47. The transmitting part 48 is permanently connected to a piston rod 49 of the pneumatic cylinder 29 via a threaded nut joint. Furthermore, the angle lever 46 is constructed with a lever arm 50 which is connected via a swivel/slide joint 51 to a drive part 52 of the thread cutter 53. The thread cutter is constructed inside a needle plate 54 which is fastened on the bearing block 39 via a web 55 with the aid of a screw 56. The design of the thread cutter 53 is known from publications DE 44 36 613 C1 and DE 195 31 727 A1 (corresponding to U.S. Pat. No. 5,647,290), to which reference is made for this design. The needle plate 54 is constructed with a bearing plate 57 on which a material to be sewn 58 lies.

A looper device 59 is mounted on the spindle 40 and is represented diagrammatically in FIG. 2 at a dash-dot region. The looper device 59 is known from known eyelet buttonhole sewing machines. The looper device 59 is essentially constructed with a looper 61, which guides a looper thread 60, and with a further looper (not shown).

Figure 3:
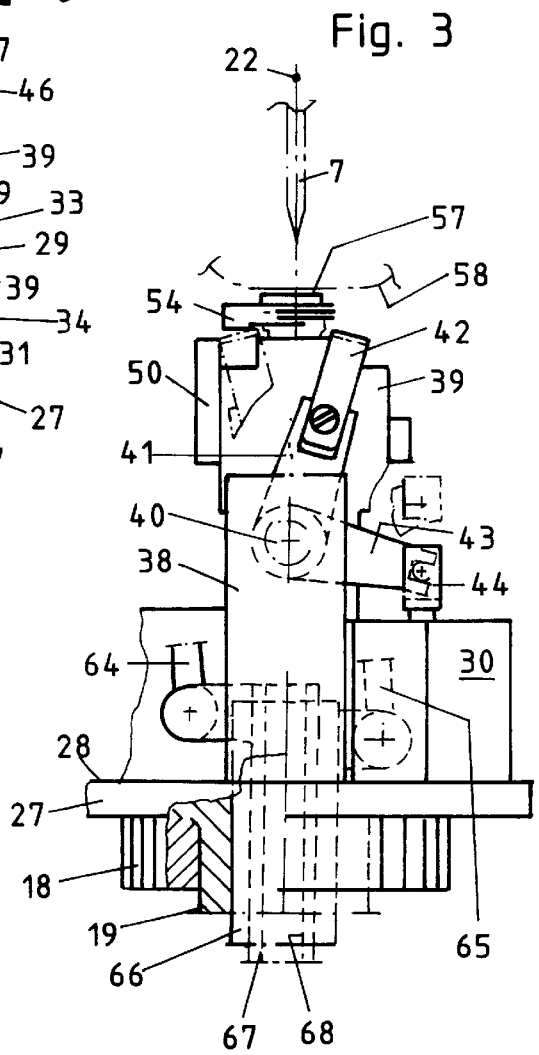
FIG. 3 shows a view of the part in FIG. 2, in the direction of the viewing arrow III in FIG. 2.
Figure 5:
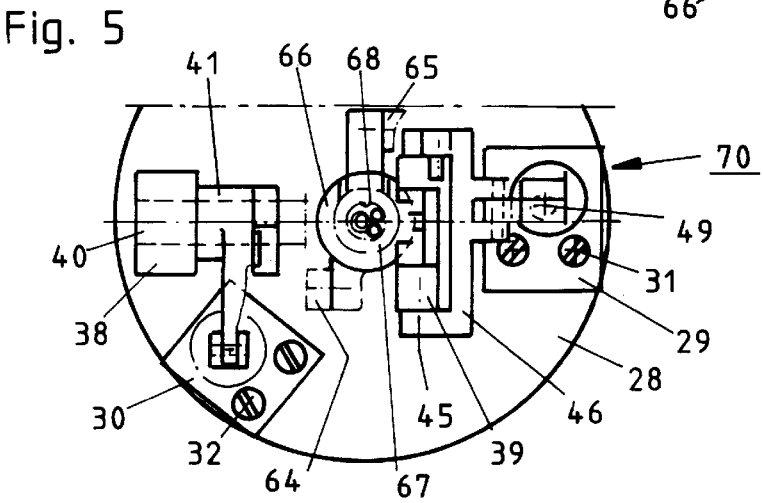
FIG. 5 shows a view of the region, shown in FIG. 2, in the direction of the viewing arrow V in FIG. 2.

The looper thread 60 is fed to the looper 61 via a tube 62, which is fastened on the flange 27 via a fastening means (not shown). The looper thread 60 comes from a thread supply (not shown) and enters the lower end 63 of the tube 62. The tube 62 terminates with its free end approximately one centimeter below the spindle 40 (FIG. 2), where the looper thread 60 emerges and runs from there to the looper 61. The looper device 59 is connected via tension bars 64, 65 to the drive tubes 66, 67. In FIG. 5, the tubes 66, 67 are arranged concentrically, and the drive tube 67 is held in an axially displaceable fashion in the drive tube 66. Further, in FIG. 3, the drive tube 66 is mounted displaceably in the hollow shaft 19. The drive tube 67 has a bore 68 through which the tube 62, the line 37 and the line 33 extend. The lines 33 and 37 are elastic plastic hoses. The hoses are laid inside the tube with an excess length, so that it is possible to rotate the looper support 70 from an initial position by an angle of rotation of approximately 400°. The lines 33 and 37 are parts of a device 69 for supplying the pneumatic cylinders 29 and 30 with energy in the form of compressed air.

The previously described hollow shaft 19 with the flange 27 and all the components fastened thereon form a looper support 70.

In FIGS. 1 and 6, the line 33 is connected to a pneumatic valve 71, and the line 37 is connected to a pneumatic valve 72. Both pneumatic valves 71, 72 are fastened near the looper support 70 on the lower region of the stationary baseplate 4. The pneumatic valves 71, 72 are three-way valves, and can be brought into two positions by electromechanical drives. The pneumatic valves 71, 72 are connected to an electric controller (not shown) of the sewing machine 1. Furthermore, the pneumatic valves 71, 72 are connected to a compressed air source 75 via lines 73, 74.

In FIGS. 1 and 7, the material to be sewn 58 lies on a table 76 whose upper side essentially extends in the plane of the bearing plate 57. The table 76 is mounted in bearings such that it can be displaced back and forth in the direction of the double arrows 77, 78. A clip 79 for the material to be sewn is also located on the table 76 to clamp the material to be sewn 58 on the table 76.

The mode of operation of the thread-cutting blade 42 and the thread cutter 53 as thread-cutting tools for the looper thread 60 and the needle thread 8 are known from the prior art mentioned. The description below concerns the mode of operation of the drive devices for the thread-cutting tools. During sewing, the pneumatic valves 71, 72 are located in the positions shown in FIG. 6. In this case, the piston rods of the pneumatic cylinders 29, 30 assume their inserted positions, which enables a buttonhole seam 80 (FIG. 7) to be produced. The required rotary movements of the looper support 70 are not prevented by the lines 33, 37, which are elastic plastic hoses held in the hollow shaft 19.

After the buttonhole seam 80 is finished, the electric controller causes the pneumatic valves 71, 72 to reverse, causing the piston rods of the pneumatic cylinders 29, 30 to be brought into their retracted positions. The associated thread-cutting tools 42, 53 are operated in the process. Consequently, both the needle thread 8 and the looper thread 60 are severed. After a short dwell time, of about 1 second, the pneumatic valves 71, 72 are again reversed, and because of the spring it contains, the pneumatic cylinder 30 is brought into its position with the piston rod inserted. In contrast, the pneumatic cylinder 29 initially executes no movement and remains in a position in which the end of the looper thread 60, which is fed from the looper 61, is held clamped by the thread cutter 53. Only after the start of a stitch group to be sewn subsequently does the controller switch over the pneumatic valve 71, and thus move back the thread-cutting tool contained in the thread cutter 53.

The thread-cutting tools 42, 53 can be operated irrespective of the rotary position of the looper support 70, since the pneumatic cylinders 29, 30 on the one hand are permanently drivingly connected to the thread-cutting tools, and on the other hand are permanently connected to the stationary pneumatic valves 71, 72 via the lines 33, 37 which are elastic plastic tubes. As is customary with an eyelet buttonhole sewing machine of this general type, the looper support 70 rotates during production of the buttonhole seam 80 and/or of a stitch group. In this case, that support reassumes its initial position at the start of each sewing operation. This is achieved by turning the looper support 70 forward and backward.

Figure 8:
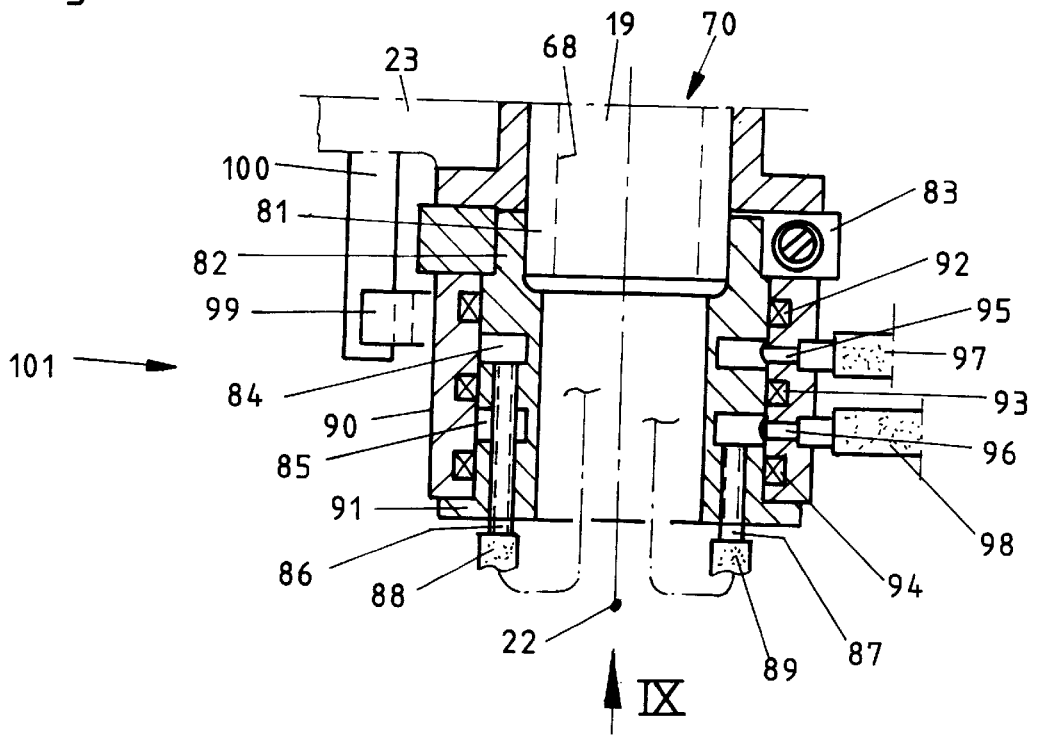
FIG. 8 shows a sectional view of the lower part of the region shown in FIG. 2, on a further enlarged scale.
Figure 9:
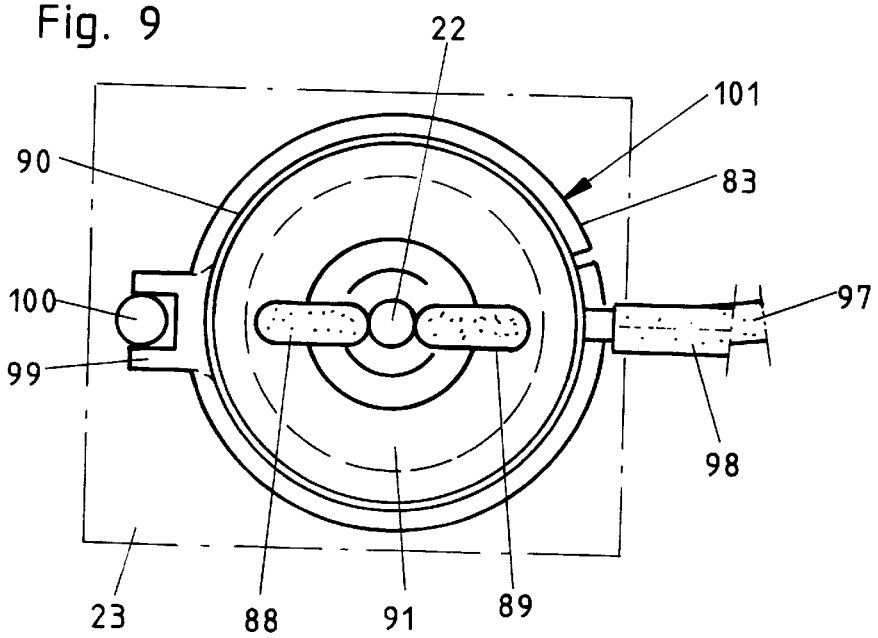
FIG. 9 shows a view of the region, shown in FIG. 8 in the direction of viewing arrow IX in FIG. 8.

A development of the device 69 is represented in FIGS. 8 and 9. An end of a tubular rotary part 82 is fastened with the aid of a clamping ring 83 on the lower end 81 of the hollow shaft 19. Two circumferential grooves 84, 85 are constructed on the rotary part 82. Terminating in the groove 84 is a tube 86 which extends through the groove 85 and which is soldered in a bore of the rotary part 82. Terminating in the groove 85 is a tube 87 which is soldered in a further bore of the rotary part 82. The end of the tube 86 which projects downward from the rotary part 82 is connected to a hose 88. The end of the tube 87 which projects downward from the rotary part 82 is connected to a hose 89. The dashed and dotted lines in FIG. 8 show the hoses 88, 89 extending into the interior of the rotary part 82, and from there into the bore 68 of the hollow shaft 19. Finally, the free ends of the hoses 88, 89 are again connected to the lines 33, 37.

Furthermore, the rotary part 82 is rotatably held in the bore of an outer ring 90. The outer ring 90 is guided axially between the clamping ring 83 and a collar 91 constructed on the rotary part 82. The outer ring 90 is constructed in the interior with grooves in which sealing rings 92, 93, 94 are arranged. The latter make sealing contact with the circumference of the rotary part 82.

In its wall axially between the sealing rings 92 to 94, the outer ring 90 includes bores 95, 96 which are connected to hoses 97, 98 via small tubes. The hoses 97, 98 terminate at the pneumatic valves 71, 72. Furthermore, the outer ring 90 carries a fork-shaped shoulder 99 which embraces with play a rod 100 arranged on the bearing 23.

The unit described having the rotary part 82 and the outer ring 90 form a rotary bushing 101. This permits the hoses 88, 89 to be fed compressed air from the hoses 97, 98, which are held in a stationary fashion, irrespective of any rotary movements of the looper support 70.

During operation of the sewing machine 1, the rotary bushing 101 has the advantage that any rotary movements of the looper support 70 can be executed without any limitation upon operation of the thread-cutting tools 42, 53. Conversely, there is no need to rotate the looper support 70 back into its initial position. Therefore, the initial position can be approached without any limitation along the shortest path, that is to say in the shortest time.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A thread cutting device for an eyelet buttonhole sewing machine comprising:

a looper support rotatable about an axis and for receiving a looper thread fed to the looper support;

a needle also extending essentially on the axis and for receiving a needle thread;

a first thread cutting tool for cutting the needle thread and also being mounted on the looper support to be movable with respect thereto;

a second thread cutting tool for cutting the looper thread and also being mounted on the looper support to be movable with respect the looper support and also to be movable independently of the first thread cutting tool;

a first drive connected to the first thread cutting tool for operating the first tool;

a second drive connected to the second thread cutting tool for operating the second tool the first and the second drives being located on the looper support;

an energy supply device for supplying the first and second drives with energy for operating and the energy supply device being provided on the looper support.

2. The thread cutting device of claim 1, further comprising an energy source for connection to the energy supply device wherein the energy source is stationary with respect to the energy supply device and with respect to the movement of the energy supply device with the looper support; and at least one line leading from the energy source to the energy supply device.

3. The thread cutting device of claim 2, wherein the looper support includes a hollow shaft extending around the axis; and the at least one line extending through the hollow shaft to the energy supply device.

4. The thread cutting device of claim 3, wherein the lines are elastic hoses.

5. The thread cutting device of claim 1, wherein at least one of the first and second drives includes a pneumatic cylinder, the energy supply device supplies pneumatic pressure to the drive device, the drive device being connected with the respective one of the cutting tools for operating the cutting tool as the energy supply device supplies pressure to the pneumatic cylinder.

6. The thread cutting device of claim 5, wherein the pneumatic cylinder is a double action pneumatic cylinder, which is pneumatically operated to move the respective cutting tool to selectively cut and retract as the pneumatic cylinder moves in each of opposite directions.

7. The thread cutting device of claim 6, wherein the other of the first and second drives includes a single action pneumatic cylinder which is connected to the other of the cutting tools, wherein the energy supply device supplies energy to the single acting pneumatic cylinder to pneumatically operate the single acting pneumatic cylinder to operate the single acting pneumatic cylinder in only one direction.

8. The thread cutting device of claim 7, wherein the pneumatic cylinder is arranged on the looper support, and the pneumatic cylinder has a longitudinal spindle which is movable and which extends essentially parallel to the axis of the thread cutting device.

9. The thread cutting device of claim 5, wherein the looper support includes a lateral radially extending flange extending radially from the axis; and the pneumatic cylinder being fastened on the looper support flange.

10. The thread cutting device of claim 1, wherein the energy supply device includes a rotary bushing for feeding energy in the form of compressed air from the energy source to the drives.

* * * * *